United States Patent [19]

Lüehr

[11] 4,206,921

[45] Jun. 10, 1980

[54] ROULETTE-TYPE GAME APPARATUS

[76] Inventor: Wolfgang Lüehr, Hauptstrasse 7, Borstel, Fed. Rep. of Germany, 2351

[21] Appl. No.: 886,900

[22] Filed: Mar. 15, 1978

[30] Foreign Application Priority Data

Mar. 16, 1977 [DE] Fed. Rep. of Germany ... 7708001[U]

[51] Int. Cl.[2] ..... A63F 5/04

[52] U.S. Cl. ..... 273/142 D; 273/142 JB

[58] Field of Search ..... 273/142 R, 142 A, 142 B, 273/142 C, 142 D, 142 E, 142 F, 142 G, 142 H, 142 HA, 142 J, 142 JA, 142 JB, 142 JC, 142 JD, 142 K, 138 R, 138 A, 141 R, 141 A; 46/59, 67, 68, 47

[56] References Cited

U.S. PATENT DOCUMENTS 2,486,752 11/1949 Michael ..... 46/47 X 2,831,692 4/1958 Keast ..... 273/142 R X

FOREIGN PATENT DOCUMENTS 397351 8/1933 United Kingdom ..... 273/142 JB

*Primary Examiner*—Richard C. Pinkham
*Assistant Examiner*—Arnold W. Kramer
*Attorney, Agent, or Firm*—Andrus, Sceales, Starke & Sawall

[57] ABSTRACT

Roulette-type game apparatus comprising a housing consisting of a base and a transparent hood, a disc for providing a plurality of game fields, a drive actuating and attenuating mechanism consisting of a rotatably mounted drive spindle, a weight slidable along this spindle and an attenuating plate, and indicators such as dice or balls freely movable within said housing between the hood and the game field.

15 Claims, 12 Drawing Figures

Fig.6c (C-C)

ROULETTE-TYPE GAME APPARATUS

The present invention relates generally to table games and particularly to a novel roulette-type game apparatus.

There exist already various game apparatus that are similar to the gambling game of roulette. Whereas in the actual roulette game the game apparatus consists of a revolving disc with red and white numbered fields and a moving ivory ball and the number at which the ball comes to a standstill is the winning number, the heretofore known modifications include compartments instead of the numbered fields, and with each compartment is associated a playing card. It is likewise possible to rotate discs bearing characters along a circular path by means of an electric motor drive whereby every player must achieve a predetermined combination of balls. A drawback of these heretofore known roulette-type game apparatus is that these apparatus are usable only for a predetermined type of game and moreover are of substantial dimensions so as to render it cumbersome to move the apparatus from one location to another.

It is, therefore, an object of the present invention to provide a novel and improved roulette type game apparatus.

It is another object of the present invention to provide a novel and improved roulette type game apparatus allowing various different roulette-type entertainment games to be played.

It is still another object of the present invention to provide a game apparatus of the above type which may be easily transported.

In accordance with the present invention, these objects are achieved in a game apparatus including a base, a signaling plate that is rotatably mounted above the base by a rotary means and adapted to perform relative rotary movements with respect to a compartment disc mounted above the signaling plate, the compartment disc adapted to receive indicating means, a hood for enclosing the base, and means for attenuating rotary movements of the signaling plate. The indicating means may consist of dice, balls or the like which are disposed below the hood and above the compartment disc.

Figure 1:
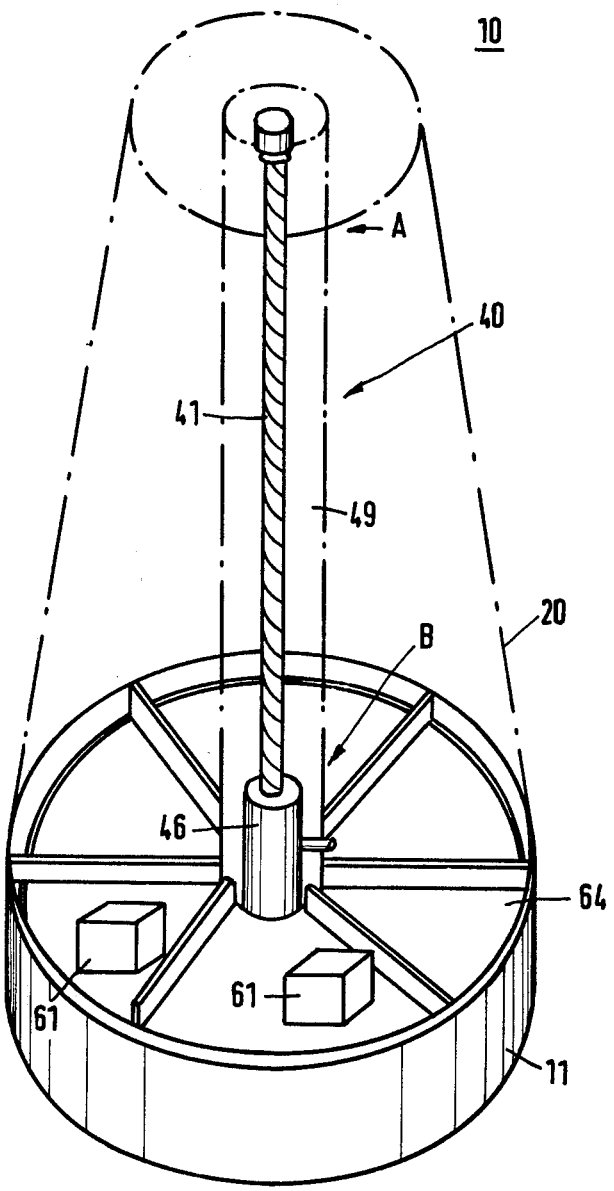
Figure 2:
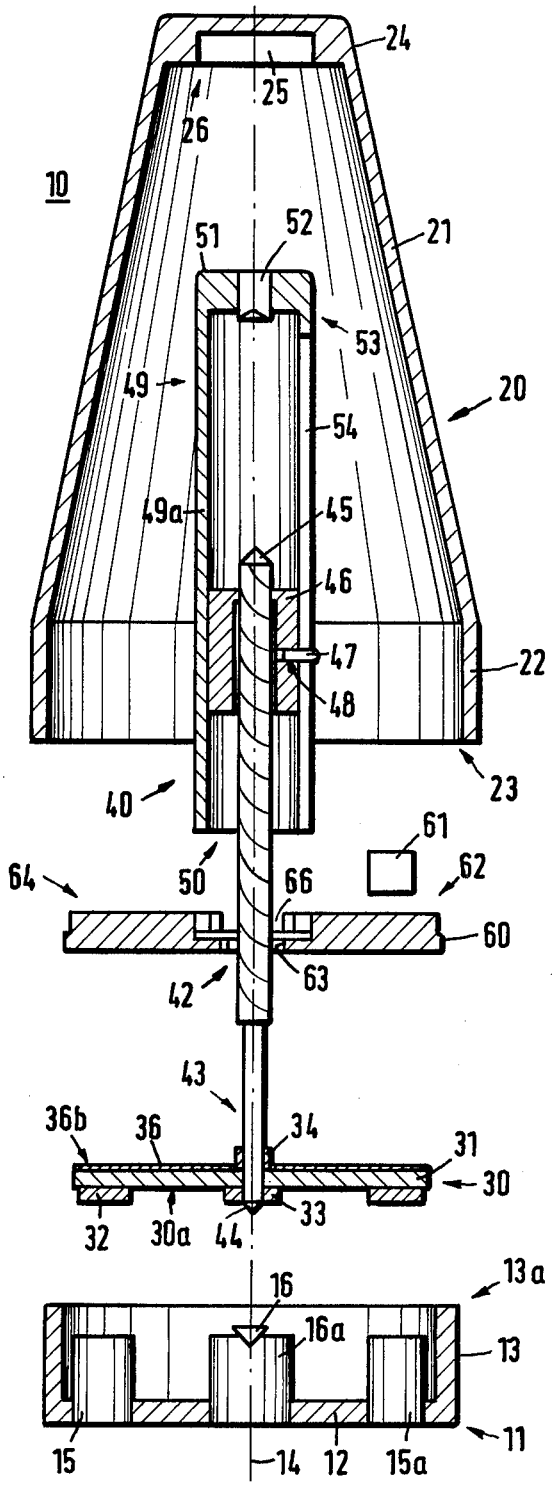
Figure 2A:
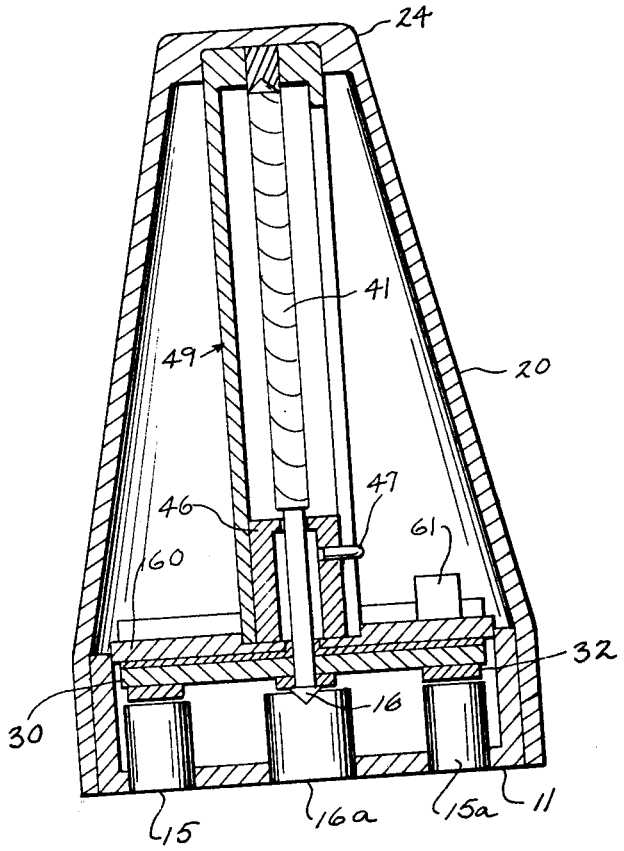
Figure 3A:
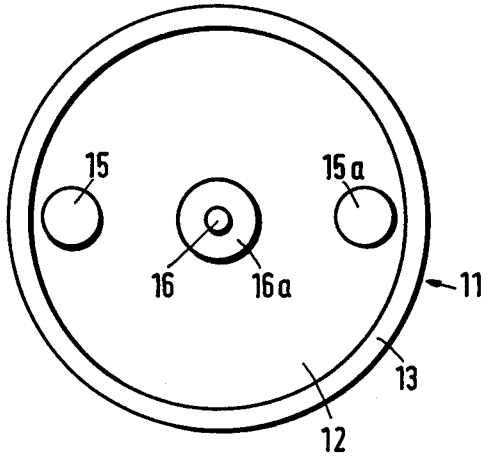
Figure 3B:
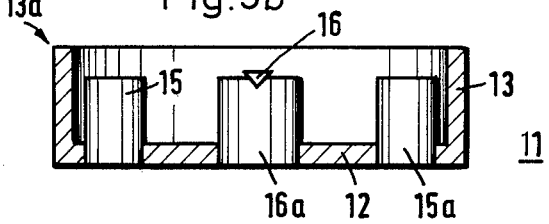
Figure 4A:
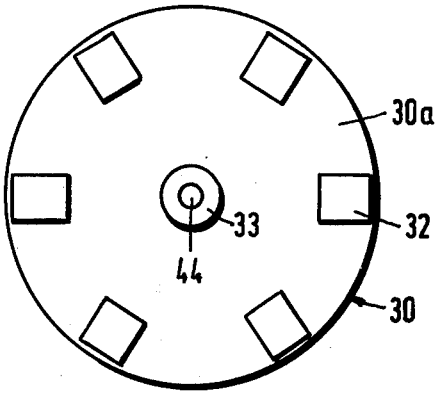
Figure 4B:
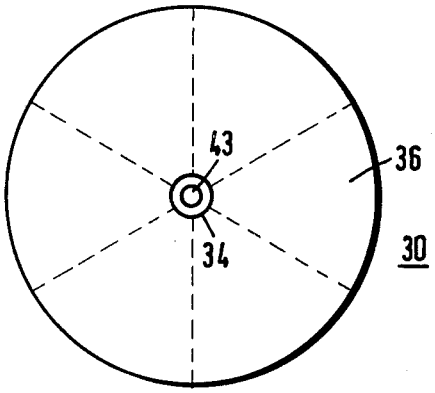
Figure 7:
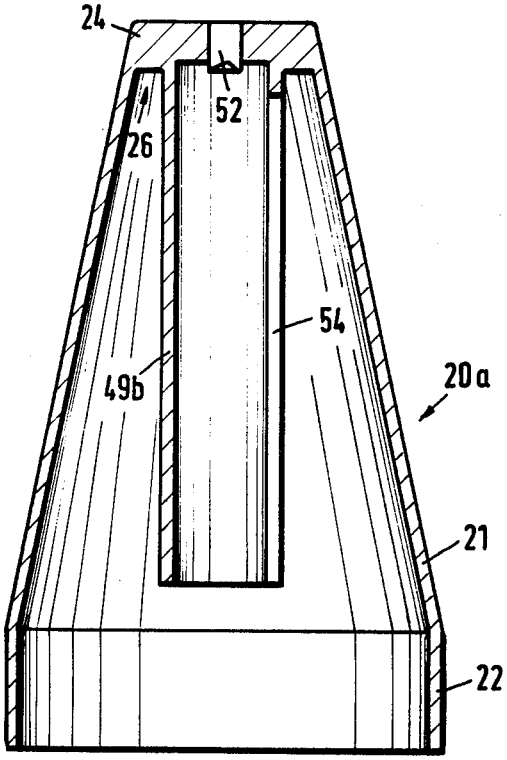
Figure 5:
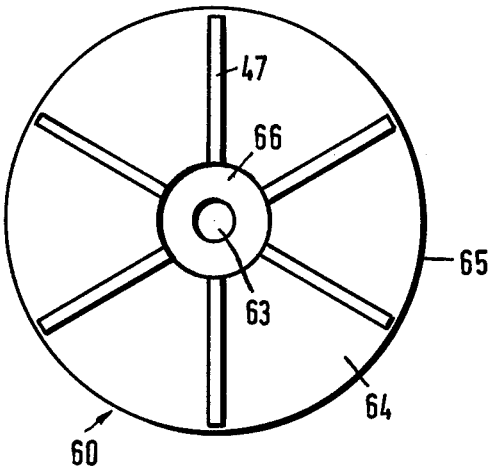
Figure 6A:
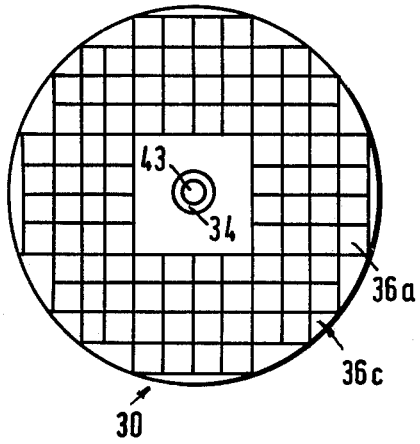
Figure 6B:
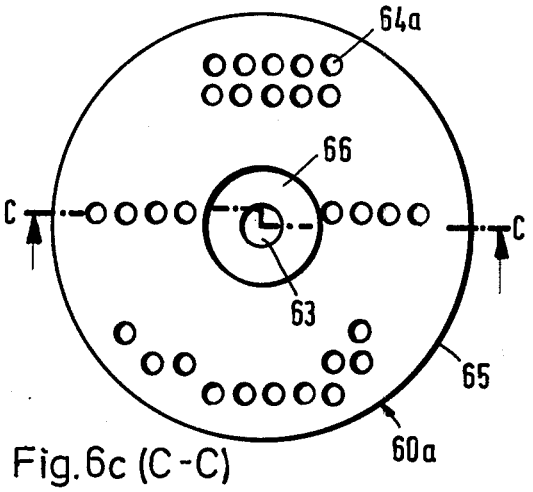
Figure 6B:
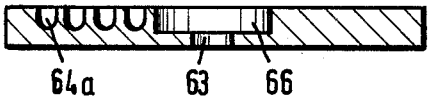

In the following, a preferred embodiment of the game apparatus of the present invention will be described more in detail with reference to the appended drawings wherein FIG. 1 is a perspective view of a roulette-type game apparatus in accordance with the present invention;

FIG. 2 is an exploded elevational sectional view of the game apparatus of FIG. 1;

FIG. 2*a* is a cross-sectional view of the game apparatus shown in FIG. 2 in the assembled condition;

FIG. 3*a* is a top view of the base of the game apparatus of FIG. 1;

FIG. 3*b* is a lateral sectional view of the base of FIG. 3*a*;

FIG. 4*a* is a bottom view of the signaling plate of the game apparatus;

FIG. 4*b* is a top view of the signaling plate of the game apparatus;

FIG. 5 is a top view of the compartment disc of the game apparatus of FIG. 1;

FIG. 6*a* is a top view of another embodiment of the signaling plate of the game apparatus;

FIG. 6*b* is a top view of still another embodiment of the compartment disc of the game apparatus;

FIG. 6*c* is a cross-sectional view of the compartment disc of FIG. 6*b* along the line C—C; and FIG. 7 is an elevational sectional view of a hood with an integral guide sleeve for the driving weight of the rotary drive actuator.

Referring to FIGS. 1 and 2, the illustrated roulette-type game apparatus 10 includes generally a base 11, a signaling plate 30, a compartment disc 60, a rotary drive actuator 40 and a hood 20.

A pair of dice constituting an indicating means 61 are contained within the space defined by the upper surface of the compartment disc 60 and the hood 20. In the illustration of FIG. 1 the dice lie in different compartments 64 of the compartment disc 60.

The base 11 includes a circular base plate 12 with an upright peripheral wall 13. A bearing mount 16*a* for receiving a bearing 16 is arranged centrally on the circular base plate 12 so that the bearing 16 is disposed coaxially of the rotary axis 14 of the rotary drive actuator 40. A pair of permanent magnets 15, 15*a* is mounted on the base plate 12 intermediate the bearing mount 16*a* and the peripheral wall 13, in mutually opposite positions (see FIGS. 3*a* and 3*b*).

The signaling disc 30 is of a disc-shaped annular configuration and of an outer diameter which is smaller than the inner diameter of the peripheral wall 13 of the base 11. The end of a portion 43 of a drive spindle 41 of the rotary drive actuator 40 extends centrally through the signaling plate 30 and projects in a downward direction beyond the bottom surface 30*a* of the signaling disc 30, in defining a trunnion 44. For increasing the rigidity of the connection of the drive spindle 41 with the signaling disc 30, a disc 33 is mounted at the bottom surface 30*a*, and another disc 34 is mounted at the top surface 36*b* of the signaling disc 30, and these discs serve to laterally guide the portion 43 with the trunnion 44 of the drive spindle 41. Metallic pads 32 are attached to the bottom surface 30*a* of the signaling disc 30 about an edge portion thereof in a predetermined angular pattern. These metallic pads 32 are adapted to be operatively coupled to each of two permanent magnets 15, 15*a* on the base 11 (see FIG. 4*a*). A game field 36 is provided on the top surface 36*b* of the signaling plate 30, and this game field provides several game symbols (see FIG. 4*b*). The game field 36 may either comprise only a few game symbols or a plurality of such game symbols by being correspondingly subdivided, as shown in the signaling plate 30 of FIG. 6*a* having a game field 36*a* with a plurality of game symbols 36*c*.

The compartment disc 60 is made of a transparent material. An opening 63 is provided centrally in the compartment disc and the outer diameter of this opening 63 is selected so that the drive spindle 41 may rotate freely within the opening without contacting the compartment disc. Several compartments 64 are arranged on the surface 62 of the compartment disc 60 facing away from the base 11 (see FIG. 5). These compartments 64 may be defined by webs 47 projecting upwardly in a predetermined pattern from the disc body 65 of the compartment disc 60. It would, however, be likewise possible to provide the compartments 64 directly within the disc body 65. FIG. 6*b* illustrates an array of a plurality of compartments 64*a* made in the disc body 65 whereby the pattern of these compartments corresponds to the pattern of the game symbols 36*c* on the game field 36*a*. The top surface of the compartment disc 60 is provided with a central opening 66 for receiving the guide sleeve 49 of the rotary drive actuator 40.

The rotary drive actuator 40 substantially consists of the drive spindle 41, a weight 46 and a guide sleeve 49. Along an end portion 42 of the drive spindle 41 facing away from the signaling plate 30 is provided a thread of a preferably high pitch, and the weight 46 is slidably movable along this thread. The lower portion 43 of the drive spindle 41 is of a reduced diameter with respect to the threaded portion 42. The length of this lower portion 43 exceeds somewhat the height of the weight 46. The weight 46 is of an outer diameter somewhat, smaller than the inner diameter of the guide sleeve so that the weight may slide along this guide sleeve. In the side wall 49*a* of the guide sleeve 49 is arranged a slot-shaped aperture 54 extending from a region below a head portion 51 of the guide sleeve 49 down to a lower sleeve opening 50. Along this slot-shaped aperture 54 is slidably movable a pin 47 which at its other end is press-fitted into a recess 48 of the weight 46. The end portion of the drive spindle 41 remote from the trunnion 44 likewise defines a trunnion 45 adapted to be journalled in a bearing 52 arranged in the head portion 51 of the guide sleeve 49. The head portion 51 of the guide sleeve 49 may be mounted in a recess 25 provided at the bottom surface 26 of the upper end 24 of the hood 20. The hood 20 consists of a conically enlarged member 21 extending downwardly from the upper end 24 and a cylindrical portion 22 integral with the lower end of the enlarged member 21, and defining an opening at its end facing away from the upper end 24. The inner diameter of the cylindrical portion 22 of the hood is selected so that this portion 22 may be slidably engaged over the peripheral wall 13 of the base 11. In this assembling operation, the trunnion 44 will be supported on the bearing 16, and the compartment disc 60 will clampingly engage the edge of a portion 13*a* of the peripheral wall 13. Simultaneously, the guide sleeve 49 will be inserted into the opening 66 of the compartment disc 60 and into the recess 25 at the upper end 24 of the hood 20.

In its normal position, the weight 46 will be supported by the compartment disc 60 in the position B, as shown, due to gravity. When the game apparatus 10 is being turned upside down through 180 degrees, the weight 46 will move into the position A adjacent the head portion 51 of the guide sleeve 49. When subsequently tilting again the apparatus 10 through 180 degrees, the weight 46 may slide downwardly from the position A into the position B and drives thereby the drive spindle 41 and by this spindle in turn the signaling plate 30. When the rotary speed of the drive spindle 41 drops below a predetermined speed, then one of the metallic pads 32 will be attracted by one of the permanent magnets 15, 15*a* so that the rotary movement of the signaling plate 30 or respectively the drive spindle 41 will be attenuated and eventually braked.

By the corresponding vibratory movements the indicating means 61 will fall at random into one or the other of the compartments 64. Since the hood 20 and the compartment disc 60 are made of a transparent material, it may readily be established with which game symbol of the game fields 36, 36*a* is associated each of the indicating means 61.

As shown in FIG. 7, the guide sleeve 49*b* may be made integrally with the bottom surface 26 of the upper end 24 of the hood 20. The bearing 52 will then be located directly in the upper end 24 of the hood 20*a*. A hood 20*a* of this type facilitates the application of the game apparatus 10 to various games.

It is merely required to replace the signaling plate 30 with the drive spindle 41 and optionally also the compartment disc 60 by another signaling plate and compartment disc respectively. The assembly is very simple, particularly when employing the hood embodiment 20*a*, since during assembling no tilting of the guide sleeve 49 may occur. The roulette-type game apparatus 10 of the present invention is highly versatile and constitutes a basic apparatus which may be employed for a wide range of different games by simply replacing the signal plates and the compartment discs.

What is claimed is:

1. A roulette-type game apparatus comprising:

a base (11);

a signaling plate (30) rotatably mounted above said base, said plate bearing symbols (36*c*) on a surface thereof for determining the character of an entertainment game;

means (60) mounted on said base above said plate and having a plurality of compartments (64) for receiving indicator means (61), said compartments being adapted for association with said symbols on said plate;

enclosure means (20) joined to said base for retaining said indicator means in said game apparatus; and drive means for producing relative rotation between said signaling plate and compartment means, said drive means comprising a drive spindle (41) mounted on said signaling plate, extending through said compartment means, and journalled in at least one of said base and enclosure means, said spindle having an upper threaded portion and a lower unthreaded portion, a non-rotating weight (46) engageable with said spindle for rotating same by movement along the threaded portion and for permitting said spindle and signaling plate to freely rotate when said weight has moved to the unthreaded portion.

2. A roulette-type game apparatus as defined in claim 1 wherein said base includes a circular base plate (12) with an upright peripheral wall (13) and centrally disposed bearing means (16) for rotatably mounting said spindle (41).

3. A roulette-type game apparatus as defined in claim 1 including means for attenuating rotary movements of said signaling plate.

4. A roulette-type game apparatus as defined in claim 3 wherein said attenuating means includes at least one magnet (15) mounted on said base and a plurality of metallic pads (32) mounted on said signaling plate and operatively associated with said magnet.

5. A roulette-type game apparatus as defined in claim 1 wherein said compartment means comprises a disc (60, 60*a*) made of a transparent material and including a central opening (63) through which extends drive spindle (41) without contacting said compartment means disc, said disc having a plurality of compartments (64) facing away from said base (11), said disc being adapted to be fixedly mounted on said base.

6. A roulette-type game apparatus as defined in claim 1 wherein said weight (46) is adapted to be moved along said spindle (41) within a guide sleeve (49) mounted within said enclosure means (20) on said compartment means (60, 60*a*).

7. A roulette-type game apparatus as defined in claim 6 wherein one end of said drive spindle (41) is adapted to be rotatably mounted in a bearing in said guide sleeve (49).

8. A roulette-type game apparatus as defined in claim 6 wherein a slot-shaped aperture (54) is arranged in the side-wall (49*a*) of said guide sleeve (49) and wherein a pin (47) connected to said weight (46) is movable along said slot-shaped aperture (54) to prevent rotation of said weight.

9. A roulette-type game apparatus as defined in claim 6 wherein said enclosure means comprises a hood (20) joined to said base to enclose said drive spindle (41) and guide sleeve (49).

10. A roulette-game apparatus as defined in claim 6 or 9 wherein said enclosure means is made of a transparent material.

11. A roulette-type game apparatus as defined in claim 9 wherein said guide sleeve is integrally molded with said hood (20*a*).

12. A roulette-type game apparatus as defined in claim 1 wherein the unthreaded portion of said drive spindle (41) exceeds the height of said weight (46).

13. A roulette-type game apparatus as defined in claim 1 wherein the threaded portion of said drive spindle (41) contains a high-pitch thread.

14. A roulette-type game apparatus as defined in claim 1 wherein said compartments (64) on said compartment means (60, 60*a*) are arranged in a pattern corresponding to the pattern of game symbols (36*c*) on said signaling plate (30).

15. A roulette-type game apparatus as defined in claim 1 wherein said indicating means comprises dice, balls, or the like.

* * * * *